United States Patent [19]

Tachibana

[11] Patent Number: 4,540,379

[45] Date of Patent: Sep. 10, 1985

[54] ARTICULATED TOY CAPABLE OF RETRACTING DRIVING WHEELS UPON ARTICULATION

[75] Inventor: Tamotsu Tachibana, Tokyo, Japan

[73] Assignee: Tomy Kogyo Company, Incorporated, Japan

[21] Appl. No.: 524,870

[22] Filed: Aug. 22, 1983

[51] Int. Cl.[3] ..... A63H 13/00; A63H 11/00

[52] U.S. Cl. ..... 446/448; 446/289; 446/337; 446/353; 446/437

[58] Field of Search ..... 446/279, 294, 298, 324, 446/330, 352–355, 431, 437, 448, 449, 466, 289

[56] References Cited

U.S. PATENT DOCUMENTS

| | | | |
|---|---|---|---|
| 196,391 | 10/1877 | Schwippl | 446/324 |
| 1,411,944 | 4/1922 | Wagner | 446/324 |
| 1,690,811 | 11/1928 | Bartley | 446/354 |
| 2,848,838 | 8/1958 | Price | 446/294 |
| 3,300,894 | 1/1967 | Glass et al. | 446/448 |
| 4,312,150 | 1/1982 | Terzian | 446/354 |
| 4,457,019 | 7/1984 | Kozuka et al. | 446/437 |

*Primary Examiner*—F. Barry Shay

*Attorney, Agent, or Firm*—K. H. Boswell

[57] ABSTRACT

A toy has a body having first and second body members which are pivotally joined together so as to allow articulation of the toy body. A motor is located in the body with a set of driving wheels located on the first body member. The toy articulates between a first and a second configuration with the driving wheels contacting a support surface in the first configuration so as to drive the toy across the support surface and being lifted upwardly from the support surface in the second configuration so as to no longer drive the toy across the support surface.

9 Claims, 7 Drawing Figures

10
26
28
48
16
20
22
24
36
34
20
30
22
14
12
32
68
52
74
46
50
74
10
50
18
44
52
68

70
64
14
66
84
82
76
12
38
72
62
80
78
72
54
42
60
42
58
56

28
16
10
74
48
84
82
66
36
76
56
78
80
14
20
50
52
12
18
40
38
68
32
44

16
10

84
74
82
36
76
48
78
66
56
52
14
80
20
50
12
18
40
38
68
32
44

ARTICULATED TOY CAPABLE OF RETRACTING DRIVING WHEELS UPON ARTICULATION

BACKGROUND OF THE INVENTION

This invention is directed to a toy having articulated parts and a motor means so as to move the articulated parts with respect to one another. More particularly, the toy includes a set of drive wheels attaching to one of the body parts with the drive wheels being connected to or lifted from a support surface in response to articulation of the parts of the toy.

Several toys are known wherein one part moves with respect to the other. In U.S. Pat. No. 2,504,679; there is a novelty toy described which mimics a set of false teeth. The toy has a motor which causes the upper plate of the teeth to move up and down with respect to the lower plate of the teeth in a manner mimicking the movement of a human jaw. Further, U.S. Pat. No. 2,931,135 describes a novelty toy which is in the shape of a pair of hands and includes a motor therein. When activated, one hand moves with respect to the other to mimic a clapping type motion. In these two patents, a first member moves with respect to a second member. The totality of the objects, however, do not mover over a surface.

In U.S. Pat. No. 3,260,016, an improved toy of the type of toys noted above is shown which includes a first part and a second part like the above toys. However, the toy also includes the ability to oscillate or jiggle on a support surface as the first part moves with respect to the second part. In this particular toy, a comical hat is attached to a pair of comical shoes and when the wind-up motor is activated, the hat jiggles with respect to the shoes and the totality of the toy jiggles on a support surface about a central boss located on the bottom of the shoes. While this toy is capable of jiggling on a support surface, its movement is restricted to a creeping motion as the toy jiggles about the boss.

The above toys are quite comical in appearance and interesting to observe. They are not, however, capable of moving to a great extent across a support surface.

BRIEF DESCRIPTION OF THE INVENTION

In view of the above, it is considered that a toy which not only is capable of having one part move with respect to the other but is also capable of moving across a support surface would be extremely interesting and would provide considerable play value and amusement in use thereof. It is therefore a broad object of this invention to provide such a toy. It is a further object of this invention to provide a toy, which because of its simple manner of operation, yet because of its novel effect, is interesting to a broad range of age groups. It is a further object of this invention to provide a toy which, because of its engineering principles and construction thereof, is capable of a long and useful life and yet is simple enough in its construction so as to allow for economic manufacturing of the same and thus wide availability of the toy to the consuming public.

These and other objects, as will become evident from the remainder of this specification, are achieved in a toy which comprises: a body having a first body member and a second body member, said first and said second body members movably joined together so to to move between a first configuration and a second configuration with respect to each other; said first body member including at least one first body member first support means and at least one first body member second support means, each of said first body member first and second support means located on said first body member and each for supporting said first body member on a support surface; said second body member including at least one second body member first support means located on said second body member for supporting said second body member on a support surface; moving means located on one of said first and said second body members and operatively associated with the other of said first and said second body members, said moving means for moving said first and said second body members between said first and said second configurations whereby when said first and said second body members are in said first configuration said first and said second body members are supported on said support surface by contact of said first body member first support means and said second body member first support means against said support surface and when said first and said second body members are in said second configuration said first and said second body members are supported on said support surface by contact of said first body member second support means and said second body member first support means against said support surface.

In the illustrative embodiment of the toy, the moving means would include a motor means such as a small spring motor. The first body member first support means would comprise at least one driving wheel attached to the motor means so as to be rotated by the motor means. When the first and second body members of the toy were in the first configuration, the driving wheel would be contactable against a support surface so as to propel the toy across the support surface, and when they were in the second configuration the driving wheel would be retracted from the support surface so as to allow the toy to remain stationary on the support surface while it is in its second configuration.

Preferredly, two driving wheels would be utilized and the second body member would include at least one second support means. This would allow the toy to be supported by three points while in both its first and its second configuration. In its first configuration it would be supported by the two driving wheels and the second body member first support means. When in the second configuration the toy would be supported by the first body member second support means and the second body member first and second support means.

In the preferred embodiment, the motor is located in the first body member and includes a shaft with a cam located thereon. A cam following member connects to the second body member and is positioned to be acted upon by the cam so as to move the first and second body member with respect to one another.

In the preferred embodiment, a third body member is also included. The totality of the first, second and third body members are hingedly connected together about a hinge axis so as to allow movement of all three of these members about this hinge axis. The third body member would move with respect to the first and second body members as the first and second body members moved between the first and second configurations.

BRIEF DESCRIPTION OF THE DRAWINGS

This invention will be better understood when taken in conjunction with the drawings wherein.

Figures 1, 2:
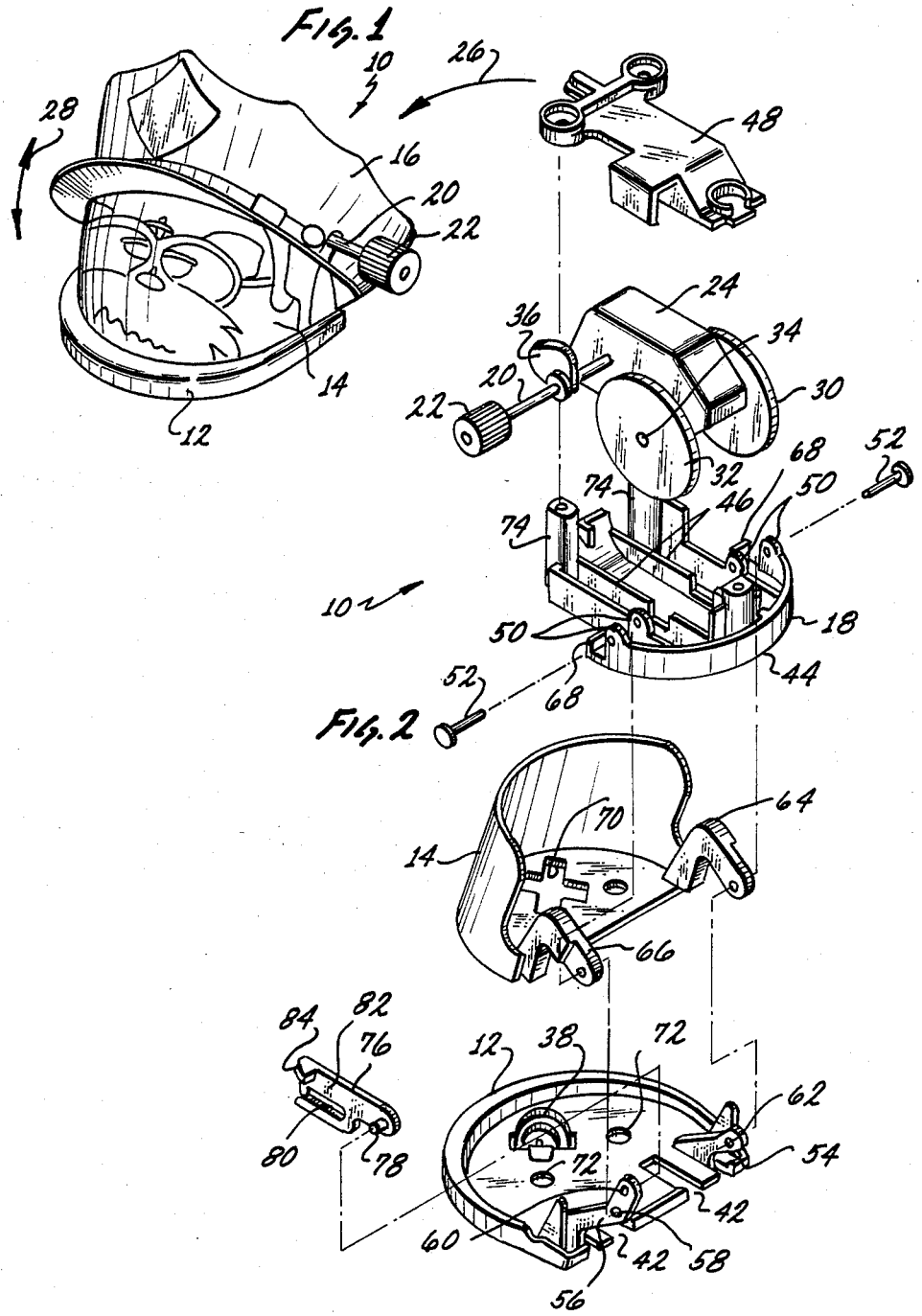
FIG. 1 is an isometric view of an embodiment of the invention.
FIG. 2 is an exploded isometric view of certain of the working parts of the invention.

The invention described in this specification and shown in the drawing utilizes certain principles and/or concepts as are set forth in the claims appended to this specification. Those skilled in the toy arts will realize that these principles and/or concepts are capable of being utilized with a variety of embodiments differing from the exact embodiment utilized for illustrative purposes herein For this reason, this invention is not to be construed as being limited solely to the illustrative embodiment, but is to be only to be construed as being limited by the claims.

DETAILED DESCRIPTION OF THE INVENTION

In FIG. 1 a toy 10 of this invention is depicted. As seen in the Fig., the toy 10 has several component parts. These include front base component 12, interior member 14, top member 16 and not seen in FIG. 1, but viewable in FIG. 2, rear base component 18. A shaft 20 having a knurled knob 22 located thereon projects sideways out of the top member 16 on the left hand side thereof.

A small spring motor 24 seen in FIG. 2 is activated by winding the knurled knob 22. When so activated, the toy 10 is then placed on a support surface. The toy moves in a large circular pathway as is depicted by the arrow 26 in FIG. 1 for a period of time and then stops and the top component 16 lifts upwardly, exposing the interior component 14 and then together the top component 16 and the interior component 14 lift further upwardly from the front base housing 12. During this lifting motion, there is no forward motion of the toy 10. Upon completion of the lifting sequence, the top member 16 moves downwardly to cover the interior member 14 and then the toy 10 once again is propelled forward. In FIG. 1, the arrow 28 depicts the up and down motion of the top member 16. At the instance of time depicted in FIG. 1 the forward motion about the arrow 26 has already ceased, and the top member 16 has already started to ascend upwardly to expose the interior member 14.

Figure 3:
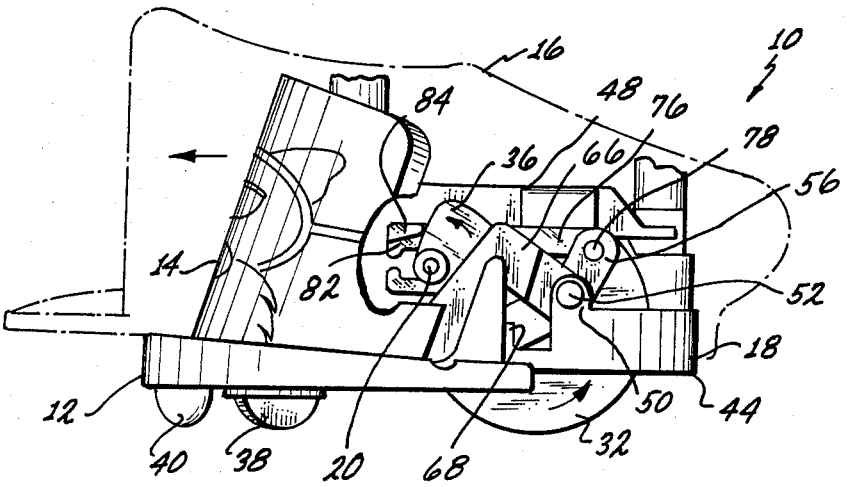
FIG. 3 is a side elevational view of the parts seen in FIG. 2 with an overlying part shown in phantom lines.
Figure 4:
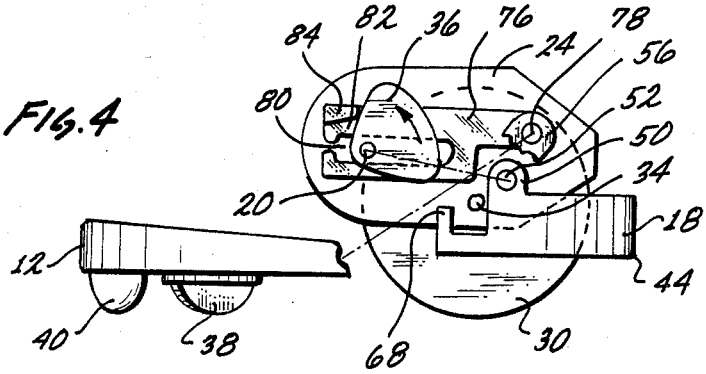
FIG. 4 is a side elevational view of a portion of the part seen in FIG. 3 showing these parts in a first spatial configuration.
Figure 5:
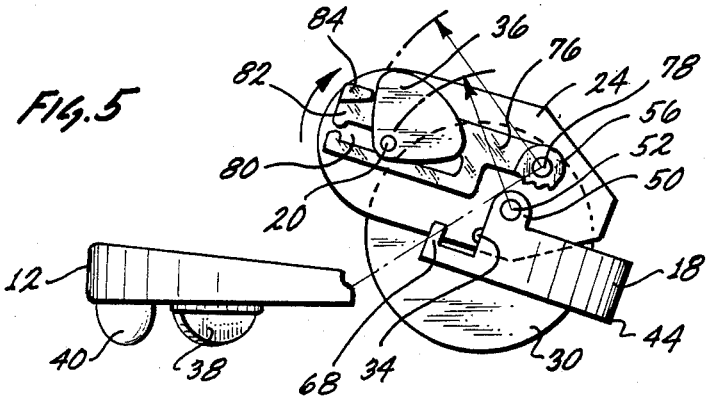
FIG. 5 is a view similar to FIG. 4 except that certain of the parts have moved to a further spatial configuration.
Figure 6:
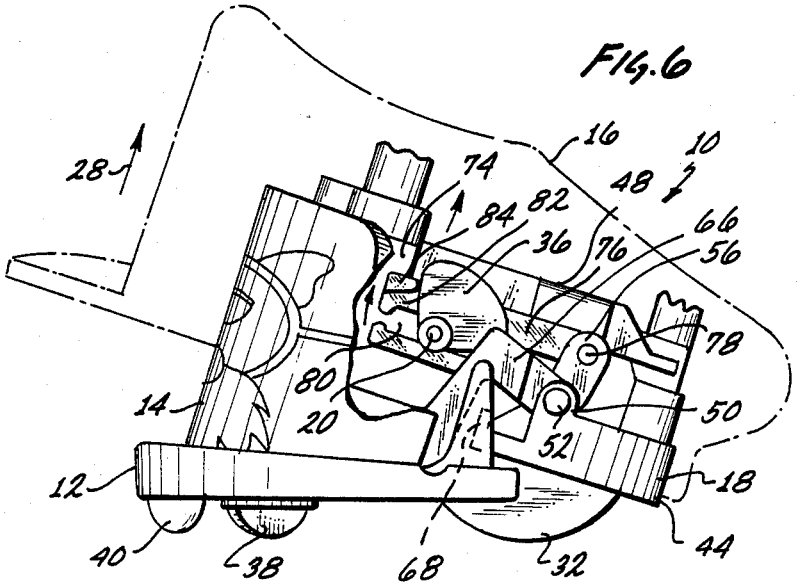
FIG. 6 is a side elevational view similar to FIG. 3 with certain of the working components located in a spatial configuration as seen in FIG. 5.
Figure 7:
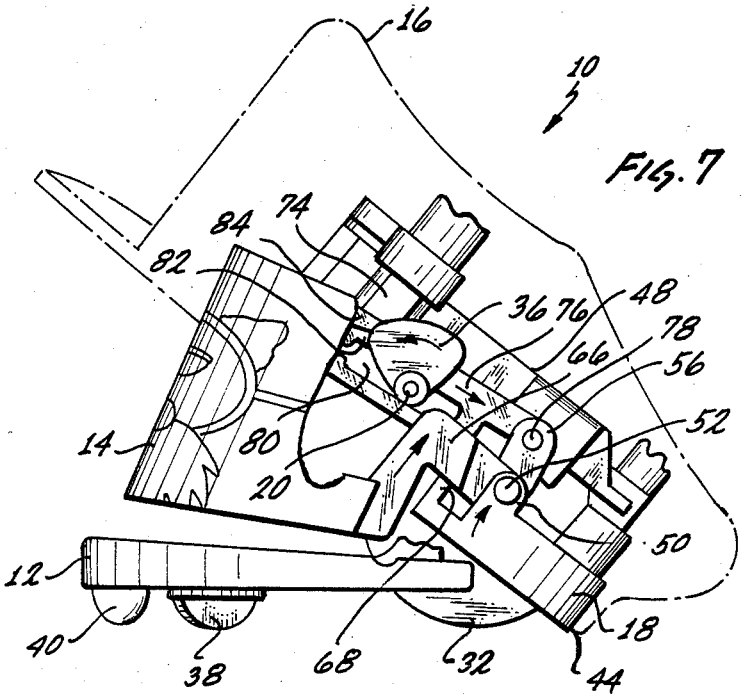
FIG. 7 is a side elevational view similar to FIG. 6 except certain of the components have moved with respect to one another to a different spatial configuration.

Referring now to FIGS. 3, 6 and 7, the top member 16 is shown in phantom lines in these three Figures. In FIG. 3 the top member 16 is in its furthest downward position, the position it is in when the toy 10 is moving forwardly. Upon cessation of the forward motion and initiation of the up and down motion, the toy is as depicted in FIG. 6. In FIG. 6, the front of the top member 16 is moving upwardly exposing the interior member 14. Moving on to FIG. 7, the interior member 14 is now moving concurrently with the top member 16 with respect to the front housing 12. The toy will then move back from the position in FIG. 7 to the position in FIG. 6 and finally, back to the position to FIG. 3 with reinstigation of the forward motion of the toy.

Looking now at FIG. 2, it can be seen that mounted to the motor 24 are a first and second driving wheel 30 and 32. Both of the wheels 30 and 32 are fixedly attached to an axle 34 which extends through the motor 24. Rotation of the axle 34 by the motor 24 in turn rotates the wheels 30 and 32. The motor 24 is a common spring motor and as such, detailed description of the same is not included in this specification.

As also can be seen in FIG. 2, a cam 36 is mounted to the shaft 20 and rotates in conjunction with the shaft 20. Rotation of the driving wheels 30 and 32 move the toy 10 forward, and rotation of the cam 36, as hereinafter explained, causes movement between the front and rear bases 12 and 18, respectively, as well as the interior member 14, with movement of the rear base 18 communicated to the top member 16 which is attached thereto.

A small front wheel 38 is mounted on the bottom side of the front housing 12. The wheel 38 is set at an angle to the forward direction of the toy 10. When the toy 10 is in a first configuration, as is seen in FIG. 3, the totality of the toy 10 is supported by the front wheel 38 and the first and second driving wheels 30 and 32. This makes a three point support for the toy 10 and as the driving wheels 30 and 32 rotate, the toy 10 is propelled forwardly and in a curved direction because of the angle at which the front wheel 38 is set. Located just in front of and to the left and right side of the wheel 38 are two small downwardly extending projections, collectively identified by the numeral 40.

When the toy is in the second configuration as is depicted by FIG. 7, the rear base 18 articulates or bends with respect to the front base 12 and the driving wheels 30 and 32 are lifted upwardly through two slots collectively identified by the numeral 42 formed in the front base 12. The backmost edge, identified by the point 44 in FIG. 2, of the rear base 18, contacts the support surface and the drive wheels 30 and 32 are lifted up from it. In the second configuration the toy 10 is then supported above the support surface by this back edge 44 in conjunction with the front wheel 38 and one of the two projections 40. Thus, in the second configuration the toy 10 is also supported by a three point support. Depending upon whether or not the center of gravity of the toy 10 is shifted to the right or left when it is in this second configuration, the front of the toy 10 will either rest on either the right or the left projection 40. These are sized and spaced downwardly from the front base 12 such that one or the other, in conjunction with the front wheel 38, supports the front portion of the toy 10 in the second configuration.

The motor 24 is cradled in the rear base 18 by resting on webs collectively identified by the numeral 46. A cover member 48 is then fitted over the motor 24 and onto the rear base 18. This fixedly hold the motor 24 in position on the rear base 18.

The rear base 18 includes four small ears, collectively identified by the numeral 50, molded thereon, with two of these on the left hand side and two of these on the right hand side. Pins, collectively identified by the numeral 52 fit within the bearing openings, not separately identified or numbered, in these ears 50. However, prior to location of the pins 52 in the ears 50, the front base 12 is aligned with the rear base such that a right side arm 54 formed on front base 12 has its end positioned between the ears 50 on the right hand side of the base member 18 and a left hand side arm 56 likewise is positioned between the two ears 50 on the left hand side of the base 18. The left side arm 56 has a first and a second hole 58 and 60, respectively, formed therein. The left hand pin 52 fits through the hole 58 to mount the left hand side of the front base 12 to the rear base 18 with the upper hole 60 forming an attachment point for a linkage member as hereinafter described which rotates the front base 12 with respect to the rear base 18. A hole 62 on the right hand arm accepts the pin 52 on the right hand side to pivotally mount the right side arm 54 to the base 18.

The interior member 14 also has a right side arm 64 and a left side arm 66. When the toy 10 is assembled, these are located adjacent to and just outboard of the arms 54 and 56 on the front base member 12 and they are aligned with the rear base member 18. Thus, both the arms 54 and 62 are positioned between the two ears 50 on the right hand side of the rear base member 18 and the arms 56 and 66 are positioned between the two ears 50 on the left hand side of the rear base 18 with the pins 52 holding the total assembly together. The hinge axis passing through the pins 52 allows for rotation of both the front base 12 and the interior member 14 with respect to the rear base 18.

The rear base 18 includes engagement fingers, collectively identified by the numeral 68, which are located just forward of and slightly below the ears 50 on both the left and right hand sides of the base 18. The engagement fingers 68 are utilized in moving the interior member 14 as hereinafter explained. The interior member 14 includes an "X" shaped cutout 70 which fits over the front wheel 38 and its supporting axle (not separately identified or numbered) when the interior member 14 is in the configuration as seen in either FIG. 3 or FIG. 6. The totality of the assembly is held together by passing screws, not shown, upwardly through access holes, collectively identified by the numeral 72 in both the front base member 12 and the interior member 14, until the screws are located within hollow bosses collectively identified by the numeral 74, formed in rear base member 18. From the interior of the bosses 74, the screws project upwardly through the cover member 48 and into appropriate bosses in the top member 16 to attach the assembly together.

A following lever 76 has a pin 78 located on one end which fits into the second hole 60 on the left side arm 56 of the front base 12. The following lever 76 is bifurcated such that a slot 80 is formed therein. The slot 80 fits around the shaft 20 between the cam 36 and the motor 24. A detent 84 is formed on the end of the upper finger 82 of the following member 76. The detent 84 interacts with the cam 36 to transmit rotation of the shaft 20 into movement of the following lever 76 which in turn moves the arm 56 which in turn moves the front base 12. These components, shaft 20, cam 36, and following member 76 comprise a linking means between the motor 24 and the arm 56 attaching to the front base 12.

As viewed in FIGS. 3 through 7, clockwise rotation of the knob 22 and the shaft 20 to which it is attached, winds up the spring motor 24. The spring motor 24, in unwinding, turns both the axle 34 to which the driving wheels 30 and 32 are attached, as well as the shaft 20 to which the cam 34 is attached, counterclockwise. Looking now at FIG. 4, as the cam 36 rotates counterclockwise, it engages the detent 84 on the following lever 76. As noted before the slot 80 in the bifurcated lever 76 fits around the shaft 20. Upon engagement of the cam 34 with the detent 84, the following lever 76 is slid to the left with the slot 80 sliding along the shaft 20. Movement of the following lever 76 to the left, however, transfers this movement to the side arm 56 by interaction of the pin 78 in the hole 60. This causes rotation of the front base 12 with respect to the rear base 18 about the hinge axis of the pins 52. Thus, as the cam 36 engages the detent 84 and shifts the following lever 76, the rear base 18 is seen to rotate clockwise with respect to the front base 12 (or looking at it in a different sense, the front base 12 is rotating counterclockwise with respect to the rear base 18).

In looking at FIGS. 3, 6 and 7, in FIG. 3 the cam 36 has just contacted the detent 84. Moving on to FIG. 6, the cam 36 has engaged the detent 84 and has caused the following lever 76 to slide to the left. In FIG. 7, the detent 84 is well onto the lobe of the cam 36 and will remain there until the cam 36 has completed about 90 degrees more of rotation.

When the rear base 18 starts to articulate with respect to the front base 12 as is seen in FIG. 6, the interior member 14 is resting on the base 12 since it is freely pivotable about the pins 52. As the rear base 18 continues to articulate or rotate with respect to the front base 12, the engagement fingers 68 on the rear base 18 engage the arms 64 and 66 of the interior member 14 (only engagement of arm 66 can be seen in the Figs.) and lift up on these arms to cause rotation of the interior member 14 about the pins 52. This is seen in FIG. 7. After the cam 36 has rotated 90 degrees from the position as seen in FIG. 7, this allows the following lever 76 to slide back to the right, allowing for rotation of the rear base 18 with respect to the front base 12 in the opposite direction to disengage the engagement fingers 68 from the arms 64 and 66 on the interior member 14, allowing the interior member 14 to once again descend downwardly and be supported by the front base 12. This, in turn, is followed by the movement of the top member 16 downwardly as the front and rear bases 12 and 18 assume a straight line as is seen in FIG. 3. Since the top member 16 is attached via the screws not separately identified or numbered, which attach it to the hollow bosses 74 of the rear base 18, the top member 16 moves in conjunction with the rear base 18.

The following lever 76 can move axially with respect to the shaft 20 a short distance along the shaft 20. This allows for winding of the spring motor 24. As the cam 26 rotates clockwise during this winding as seen in FIGS. 3 through 7, the cam 36 engages the outside edge of the detent 84 which is wedge shaped, as is evident from viewing the Figs., and depresses detent 84 inwardly along the shaft 20 toward the motor 24. This would be movement inwardly toward the plane of the paper as viewed in the Figs. This allows winding of the spring motor 24 without the clockwise rotation of the cam 36 moving the following lever 76 such that the slot 80 slides along the shaft 20.

When the toy 10 is in the configuration as seen in FIG. 3, as noted above, it is supported on a support surface by a three point contact comprising the driving wheels 30 and 32 and the front wheel 38. During this time, rotation of the driving wheels 30 and 32 cause forward movement of the toy 10 about a curved path dictated by the angle of the front wheel 38. When the toy 10 has articulated to the position as seen in FIG. 7, the driving wheels 30 and 32 have been retracted from the support surface and the toy 10 is then supported by the back edge 44 as a first support point, the front wheel 38 as a second support point and one of the projections 40 as a third support point. Since the driving wheels 30 and 32 are no longer in contact with the support surface at this time, forward motion of the toy 10 has ceased and only upward and downward motion of the top member 16 and the interior member 14 is evident. After the cam 36 has rotated counterclockwise beyond the detent 84, the weight of the top member 16 and the internal components attaching to the rear base 18 reposition the rear based 18 in the first configuration with respect to the front base 12 as seen in FIG. 12. As the rear base 18 repositions itself and the engagement finger 68 descends, it concurrently allows repositioning of the interior member 14 to the configuration seen in either FIG. 1, 3 or 7.

I claim:

1. A toy which comprises:

a body having a first body member and a second body member, said first and said second body members movably joined together so as to move between a first configuration and a second configuration with respect to each other;

said first body member including at least one first body member first support means and at least one first body member second support means, each of said first body member first and second support means located on said first body member and each for supporting said first body member on a support surface;

said second body member including at least one second body member first support means located on said second body member for supporting said second body member on a support surface;

moving means located on one of said first and said second body members and operatively associated with the other of said first and said second body members, said moving means being for moving said first and said second body members between said first and said second configurations whereby when said first and said second body members are in said first configuration said first and said second body members are supported on said support surface by contact of said first body member first support means and said second body member first support means against said support surface and when said first and said second body members are in said second configuration said first and said second body members are supported on said support surface by contact of said first body member second support means and said second body member first support means against said support surface;

said first body member first support means comprising at least one driving wheel rotatably mounted on said first body member;

said moving means includes a motor means, said driving wheel being operatively connected to said motor means so as to be rotated by said motor means;

said driving wheel being located on said first body member in a position to contact said support surface when said first and said second body members are in said first configuration so as to propel said body over said support surface;

said first body member second support means being located on said first body member in a position in association with said driving wheel so as to lift said driving wheel upwardly from said support surface disrupting the contact of said driving wheel and said support surface when said first and said second body members are in said second configuration.

2. The toy of claim 1 including:

at least one second body member second support means located on said second body member, said second body member second support means in conjunction with said second body member first support means being for supporting said second body member on said support surface when said first and said second body members are in said second configuration.

3. The toy of claim 1 wherein:

said first and said second body members are hingedly connected to one another;

said moving means further including linkage means, said linkage means operatively associated with said motor means and operatively connecting said first and said second body members, said motor means moving said linkage means and in turn said linkage means moving said first and said second body members about said hinge means to move said first and said second body members between said first and said second configurations.

4. The toy of claim 1 wherein:

said first body member first support means includes two driving wheels each operatively associated with said motor means and rotated by said motor means.

5. The toy of claim 4 wherein:

when said first and said second body members are in said first configuration said body is supported on said support surface about three points, two of said points comprising said driving wheels and a third of said points comprising said second body member first support means;

when said first and said second body members are in said second configuration said body supported on said support surface by three points, one of said points comprising said first body member second support means, one of said points comprising said second body member first support means and a third of said points comprising said second body member second support means.

6. The toy of claim 1 wherein:

said second body member first support means comprises a wheel rotatably mounted to said second body member.

7. The toy of claim 3 wherein:

said linkage means includes a shaft rotatably mounted in association with said motor means and rotated by said motor means;

a cam means located on said shaft, said cam means rotated in response to rotation of said shaft;

a follower means located in association with said cam means so as to be moved by said cam means;

said motor means including said shaft located on one of said first and said second body members and said follower means attaching to the other of said first and said second body members whereby rotation of said shaft is transferred by said cam means to said follower means to move said other of said first and said second body members with respect to the one of said first and said second body members.

8. The toy of claim 7 wherein:

said motor means is located in said first body member and said follower means is operatively connected to said second body member.

9. The toy of claim 8 wherein:

said second body member includes a lever means, said lever means having its fulcrum located at the hinge axis between said first and said second body members, said follower means attaching to said lever means.

* * * * *

UNITED STATES PATENT AND TRADEMARK OFFICE

CERTIFICATE OF CORRECTION

PATENT NO. : 4,540,379

DATED : SEPTEMBER 10, 1985

INVENTOR(S) : TAMOTSU TACHIBANA

It is certified that error appears in the above-identified patent and that said Letters Patent is hereby corrected as shown below:

Column 1, Line 25 "mover" should be --move--.
Column 3, line 27 add the punctuation mark "." after the word "herein".
Column 3, line 29 delete the first occurrence of the words "to be".
Column 5, line 66 "34" should be --36--.
Column 6, line 2 "34" should be --36--.
Column 6, line 50 "26" should be --36--.
Column 7, line 12 "based" should be --base--.
Column 7, line 17 "7" should be --6--.

Signed and Sealed this

*Eighteenth* Day of *March 1986*

[SEAL]

*Attest:*

DONALD J. QUIGG

*Attesting Officer*

*Commissioner of Patents and Trademarks*